United States Patent [19]

Cwayna et al.

[11] 4,000,333

[45] Dec. 28, 1976

[54] METHOD FOR ELECTROSTATICALLY COATING NON-CONDUCTIVE MATERIALS

[76] Inventors: Michael J. Cwayna, 3748 N. 14th St.; Daniel R. Baumann, 2603 Wedemeyer St., both of Sheboygan, Wis. 53081

[22] Filed: Sept. 5, 1975

[21] Appl. No.: 610,685

Related U.S. Application Data

[63] Continuation-in-part of Ser. No. 416,426, Nov. 16, 1973, abandoned.

[52] U.S. Cl. ..... 427/27; 427/325; 427/402

[51] Int. Cl.[2] ..... B05D 3/06

[58] Field of Search ..... 427/27, 299, 322, 325, 427/402

[56] References Cited

UNITED STATES PATENTS 3,236,679 2/1966 Spiller et al. ..... 427/27

*Primary Examiner*—John H. Newsome

*Attorney, Agent, or Firm*—James R. Cwayna

[57] ABSTRACT

A method for electrostatically coating normally non-conductive materials, particularly wood products and more particularly assembled wood products, which includes initially covering the entire product with a carrier solution having a conductive coating material as a portion thereof, drying the same, thereafter grounding the same and thereafter applying the desired covering material thereto, which covering material is delivered from a charged source such that an attraction between the charged covering material particles and the article to be covered will exist.

6 Claims, No Drawings

METHOD FOR ELECTROSTATICALLY COATING NON-CONDUCTIVE MATERIALS

This application is a continuation-in-part of applicants' previous application, Ser. No. 416,426, filed Nov. 16, 1973, now abandoned, under this same title.

FIELD OF THE INVENTION

This invention relates generally to methods for electrostatically coating articles and more specifically relates to a method for coating a normally non-conductive material such as wood such that subsequent coverings may be applied thereto which coverings may penetrate the coated surface and act upon the wood.

BACKGROUND AND OBJECTS OF THE INVENTION

The prior art of electrostatic application of coating and covering materials has been primarily limited to coating of conductive surfaces. Various attempts have been made to provide normally non-conductive surfaces, such as wood, with a suitable coating material which will permit subsequent covering of the same through electrostatic processes. In general, with regard to the application of such materials to non-conductive surfaces, these attempts have not been successful.

A primary difficulty with these present methods, when dealing with wood and the effect of the wood is to be realized, is the permeation of the applied conductive coating such that the wood itself may be stained or colored and subsequent coatings may be applied thereover.

It has not been difficult with the prior art to apply, through the electrostatic processes, coverings to wood products which coverings do not bring out the graining or other wood qualities.

Applicants' concepts have eliminated these difficulties and have permitted the utilization of electrostatic application of materials in the wood finishing field.

It is therefore an object of applicants' invention to provide a method for the electrostatic application of coatings to normally non-conductive materials such as wood.

It is a further object of applicants' invention to provide a method for electrostatically coating normally non-conductive materials by providing and maintaining a conductive surface on the material, which surface will permit covering materials to be applied to the material, which covering will then properly adhere to the material upon which the finish is desired.

It is still a further object of applicants' invention to provide a method for coating normally non-conductive articles which coating will allow at least one subsequent covering material to be applied to the article, which covering will penetrate the coating and act upon the article.

It is still a further object of applicants' invention to provide a method for electrostatically applying finishing materials to assembled wooden furniture and the like.

It is yet a further object of applicants' invention to provide a method for the electrostatic application of various transparent furniture finishing materials to wooden furniture.

These and other objects and advantages of applicants' invention will more fully appear from the accompanying description.

As stated, one of the applicants' primary objects of this invention is to provide a method and inclusive within the method, the material, which will permit the electrostatic application of a coating material to normally non-conductive materials such as wood and more particularly assembled furniture units made of wood which coating material will allow the application of various subsequent covering materials such as stains or the like to the unit, which stain and covering materials are well known in the trade and which application and desired result are well known in the trade and are consistent with wood finishing processes.

An important differentiation in the terminology of finishing must be presented. Finishing as known in the furniture trade and and art will bring out the qualities of the wood such as the grain and texture thereof without obscuring the same. Finishing in other arts could include painting the article but painting would not bring out the characteristics and quality of the wood. Applicants process pertains to the initial treatment of the raw wood through the entire finishing procedure which may include the staining of the wood to obtain the proper coloration thereof and the following operations to arrive at a finished product which will still show the graining quality and color of the stained wood. Important in the applicants' concept is the transparency of the materials utilized in the following operations which will allow the wood qualities to be visible.

It is necessary for applicants' method and the final desired results, to permit the application of various materials as though the article to which the application being made were in its normal non-conductive condition. In other word, it is essential that when applying stain to obtain a desired color, the conductive coating does not prevent permeation and penetration of the wood and, likewise, the conductive coating does not prevent the proper adhesion of the overlay materials, such as varnishes to the wood.

Applicants have found that various conductive coating materials in a liquid state are commercially available. One such material is produced by the Electro-Cote Chemicals Co., Inc. and is commercially available under the tradename E.C.C. No. 125 Conductive Coating. This material is a 12% solution in Isopropyl Alcohol of a surface active agent comprised of a $C_8$ to $C_{18}$ Alcohol which is sulfated and then neutralized with an amine. It therefore belongs to the anionic type of surfactants.

Applicants have found that though such a conductive coating, when applied in a full strength situation, does provide a conductive surface for subsequent applications of material through the electrostatic process, is relatively unsuitable in such strength when attempting to bring out the various tones and colors of the woods and when attempting to follow the normal wood finishing processes. Applicants have found that such conductive coatings must be utilized only in a manner that will not permit them to totally seal the wood and prevent the normal wood finishing processes.

Applicants have found that a combination of materials which include aromatic solvents, a conductive coating material such as defined above in combination with butyl alcohol may be properly combined to provide a conductive coating which is non-grain raising, relatively rapid drying, residue free and electrically conductive while still permitting the normal finishing procedures which includes staining of the wood which requires permeation and penetration of such coating.

In the formulation of this material, the applicants have found that the aromatic solvents should be provided in the range of 70 to 90% and more preferably in the range of 85 to 90%. The conductive coating material, taken as full strength, should be provided from at least 1 to 10% and preferably in the range of 1 to 5%, and the butyl alcohol should be provided in the range of 1 to 20% and preferably in the range of 1 to 5%.

As stated, it would be possible to provide the conductive coating material in a full strength form but this would totally impede the application and the desired result from the application of subsequent covering materials as normally applied in the wood finishing process. Therefore, although the applicants have cited a most useable range of the conductive material to be provided in the final solution, they have found that a final solution containing less than 5% of such material will provide a suitable coating which will provide for permeation and penetration of the initial coating and will provide for the conductivity for subsequent covering materials which are applied, for example, after the staining process has been completed. The above ratios are all stated by volume.

Applicant has further found that although the volumetric measurements provide a solution that is substantially accurate for the desired application, that a more practical method method for properly determining the final ingredients is to initially mix the aromatic solvent and the conductive coating material in the ratio of from 20 to 30 to 1. This mixture will result in a relatively milky substance and thereafter the butyl alcohol is added until the substance becomes clear.

Applicant has further found that the ultimate mixture should have a resistance of between 0.04 and 0.15 megohms and this reading should be preferably within the range of 0.07 and 0.10 megohms. These resistance readings are made in the final liquid solution through the utilization of standard paint test probes, such as the Ransburg 203/6528 Standard Paint Test Probe or the Ransburg 219/5650 Paint Resistance Tester, which are commercially available and are arranged for measuring the electrical resistance of any paint or similar preparation.

The particular ratios of the final solution, as indicated above, are those that the applicants have found to provide the desired results but it should be obvious that a useable formulation may be provided while maintaining the proper resistance reading of the final product.

The electrostatic application processes are well known to those skilled in the art. The concept is to charge liquid particles an dispel them toward an oppositely charged surface. Normally in the case of electrostatic spray, the article is grounded and therefore, a high negative or high positive voltage is applied to the particles of liquid which will cause the attraction thereof to the grounded article. The charging is done at a very low amperage level and the applicants have found that the voltage level should be at least 40KV and thereabove and when utilizing the final material as discussed hereinabove, a 60KV level is well within the operative range.

Applicants have found that the electrostatic process wherein particles are charged with the stated voltages and the article to be coated is grounded performs properly, but additional benefits are gained by atomizing the particles and additional advantages are obtained by atomizing and pressurizing the particles for discharge. This later pressurizing may be through the use of conventional spray methods. The necessity of utilizing a pressurizing system in addition to the electrostatic system when spraying assembled pieces is that it is necessary to insure interior corner coverage of the article. The corona effect will normally prevent total coverage of such interior corners unless the dispelling of the particles is accompanied with pressure.

In the utilization applicants' method, the material is prepared in the manner as stated and the article must obviously be covered with such material. Applicants have found that, particularly with assembled pieces of furniture, dipping of the article into the prepared solution will insure total coverage thereof. After dipping, the article is allowed to dry either under air or under force-dried conditions until the surface is at least dry to the touch. At this point, the carrier solution has been eliminated from the surface of the article and only the conductive coating material remains thereon and at this point it is only necessary to ground the article and direct the charged particles of the covering materials at the article.

Unlike conventional spraying methods which only cover the area at which the spray is directed, the electrostatic situation will permit the particles to surround the coated surfaces of the article due to the attraction thereof and the particles will substantially cover the surface of the article. As is further known with electrostatic spraying, particles having the same charge will repel each other and as they travel to the oppositely charged article, they will spread. This will provide a wide angle rather than a narrow angle of spray.

Applicants have found that the application of a staining material through electrostatic dispersement towards the grounded article will result in penetration of the coating and thus penetration of the wood with the resultant coloring thereof without disturbing the conductivity of the coating material. Applicants have found that utilization of this conductive coating provides a situation in which the coating remains on the surface of the article or in a position relatively closer thereto to provide the required continued conductivity for attraction of subsequent covering layers. In addition to an electrostatic staining process, when using stains which require a wiping application, that there is no disruption of the conductive coating through such wiping.

The method, as set forth herein, basically includes the proper preparation of the coating media, which media has a proper resistance reading, completely coating the article to be finished with the media, allowing the same to reach a certain degree of dryness, providing a charge to the article or grounding the article, and directing an oppositely charged covering material in fluid state to the article.

Substantial savings in material should be obvious from the concept of surrounding the article and the attraction of the particles thereto. Obviously in a normal, non-electro, spray situation those particles that pass a surface are lost. In the electrostatic process, these particles are drawn back to the charged surface.

Although the applicants and those well skilled in the art are well aware of the art of electrostatic application of materials to various surfaces, it should be obvious to those skilled in the art that applicants concept results in the utilization of normal wood finishing techniques which has heretofore been unobtainable, particularly when considering assembled pieces of furniture.

What we claim is:

1. The method of electrostatically applying protective and finishing materials to various normally nonconductive surfaces, such as wood, such method including the steps of:

a. providing a material in fluid state which material consists of a mixture of;
   1. aromatic solvents, 70 to 90% by volume;
   2. butyl alcohol, 1 to 20% by volume; and,
   3. a conductive coating material consisting of a 12% solution by weight in Isopropyl Alcohol of a surface active agent based on a $C_8$ to $C_{18}$ Alcohol, 1 to 10% by volume;
b. coating the surface with such provided material;
c. drying the surface;
d. applying an electrical charge to the dried surface; and,
e. directing a finishing material in fluid state at such surface, said finishing material having an electrical charge opposite to the charge placed on said dried surface.

2. The method set forth in claim 1 including atomizing and pressurizing said finishing material prior to directing the same.

3. The method as set forth in claim 1 and said conductive coating material being sulfated and neutralized.

4. The method as set forth in claim 1 wherein said material combining said aromatic solvents, said butyl alcohol and said conductive coating material has an electrical resistance of a range of between 0.04 and 0.15 megohms when measuring the resistance thereof with standard paint test probes.

5. The method as set forth in claim 4 and said resistance range being between 0.07 and 0.10 megohms.

6. The method as set forth in claim 1 and said amounts of said ingredients being in the range by volume of:

a. aromatic solvents: 85 to 90%;
b. butyl alcohol: 1 to 5%; and,
c. conductive coating material: 1 to 5%.

* * * * *